United States Patent [19]

Rolleri

[11] Patent Number: 5,003,658

[45] Date of Patent: Apr. 2, 1991

[54] COMPACT SANITARY TOOTHBRUSH

[76] Inventor: Dennis A. Rolleri, 117 Center St., Nutley, N.J. 07110

[21] Appl. No.: 266,659

[22] Filed: Nov. 3, 1988

[51] Int. Cl.[5] ..... A46B 17/04

[52] U.S. Cl. ..... 15/185; 15/167.1

[58] Field of Search ..... 15/185, 22 R, 167 R, 15/167 A; 300/21

[56] References Cited

U.S. PATENT DOCUMENTS

| | | | |
|---|---|---|---|
| 1,537,467 | 5/1925 | Ingle | 15/185 |
| 1,967,775 | 7/1934 | Kantor | 15/185 |
| 2,083,728 | 6/1937 | Mayer | 15/185 |
| 2,353,963 | 7/1944 | Landesman | 15/185 |
| 2,505,547 | 4/1950 | Howard | 15/185 X |
| 2,790,449 | 4/1957 | Hennings | 15/185 X |
| 4,482,263 | 11/1984 | Palamara | 15/185 |

FOREIGN PATENT DOCUMENTS

| | | | |
|---|---|---|---|
| 257827 | 10/1967 | Fed. Rep. of Germany | 15/185 |
| 614934 | 11/1926 | France | 15/185 |
| 688799 | 5/1930 | France | 15/185 |
| 886110 | 6/1943 | France | 15/185 |
| 18476 | of 1912 | United Kingdom | 15/185 |

*Primary Examiner*—Frankie L. Stinson
*Attorney, Agent, or Firm*—Michael J. Weins

[57] ABSTRACT

The present invention is directed to a toothbrush and in particular to a combination folding toothbrush-toothpaste system. The system is compact and can be readily made tamper resistant. The folding toothbrush is readily carried in one's pocket or purse.

The toothbrush of the present invention in its simplest form has a two section handle. A first handle section having a brush end with bristles and a second handle section having a terminal end with a protrusion containing a reservoir. The reservoir is contoured to conform to the profile of the brush.

Means for connecting and pivotally rotating the first handle section with respect to the second handle section are provided. It is preferred that the pivotable motion be limited between the first handle section and the second handle section such, that when the toothbrush is in the open position the protrusion and the bristles of the brush are diametrically opposed. When the toothbrush is in a closed position the reservoir encompasses the bristles.

5 Claims, 2 Drawing Sheets

FIG-1
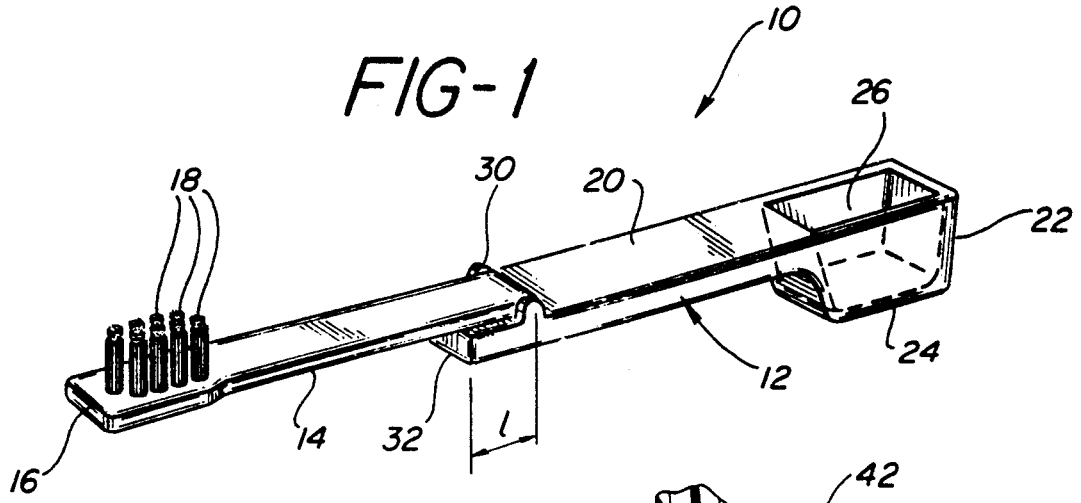
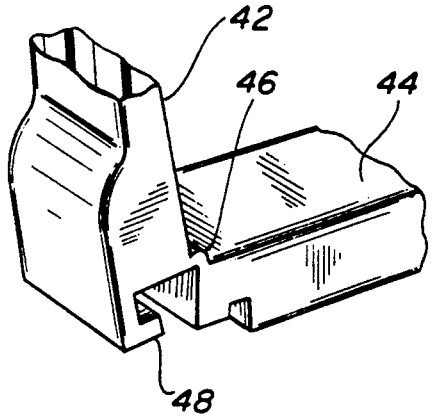
FIG-2
FIG-3
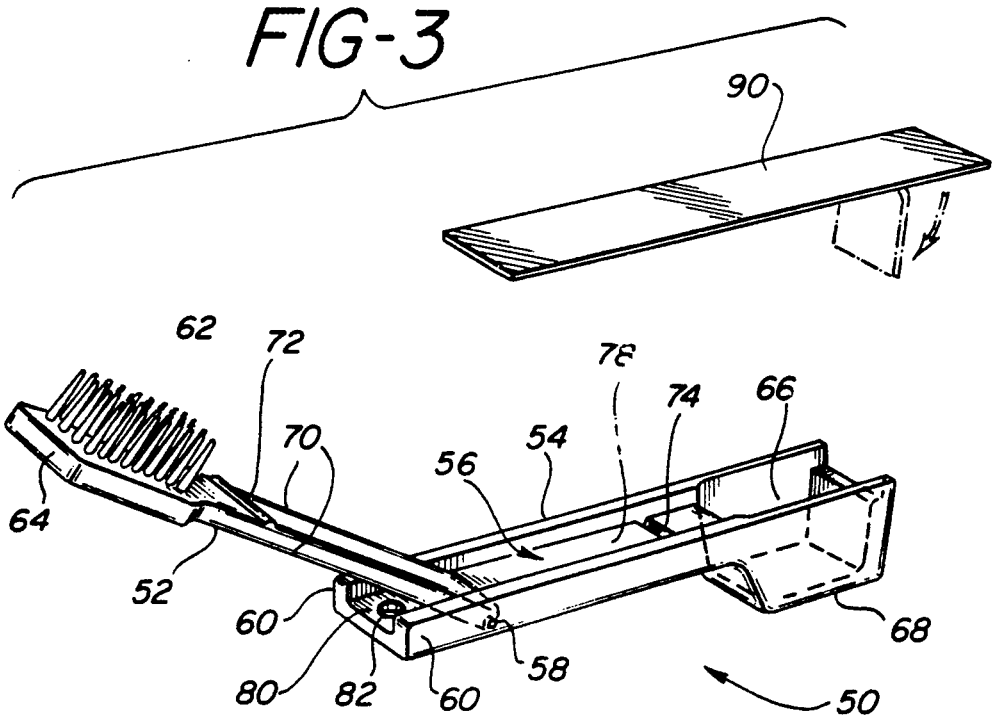

COMPACT SANITARY TOOTHBRUSH

FIELD OF INVENTION

The present invention is directed to a compact folding toothbrush, and in particular to a combination folding toothbrush toothpaste system.

BACKGROUND ART

People have been using variations of toothbrushes for thousands of years. It is believed some of the early toothbrushes were devised by Egyptians and were made from wood which was softened so the individual fibers separated to form individual "bristles". The wood fibers were subsequently replaced by animal fibers. In the 1930's Dupont developed nylon. Bristles made from nylon replaced the animal fiber bristles.

As man traveled more there developed a need for "traveling toothbrush". One of the early accessories for the "traveling toothbrush" was a vented case into which the toothbrush could be placed. Vented cases provided two functions. The case kept the wet bristles away from surrounding objects while allowing the brush to dry, avoiding mold and mildew. These cases varied in style and design. Some designs enclosed the total toothbrush, while other designs covered only the the portion of the toothbrush having the bristles.

Another approach to isolate the wet "traveling toothbrush" has been provided by the Oral-B toothbrush. This brush has a two piece handle. A first piece has a vented cavity while a second piece has a brush end. When the toothbrush is in use the first piece attaches to the second piece and extends the handle. When stored the brush end is placed n the hollow vented cavity of the first piece.

An alternative to having a detachable vented hollow handle piece was to have the toothbrush fold into a vented handle as the blade of a jackknife folds into a slot in its handle. The slot into which the toothbrush folds provided additional venting.

While the above illustrations of handles and traveling cases offered partial solutions to the "traveling toothbrush", there is still the problem of what to do about the toothpaste. U.S. Pat. No. 4,692,047 is an example of a toothbrush that has toothpaste stored in the handle of the toothbrush and which employes a pump mechanisms contained in the handle to extrude the toothpaste onto the bristles of the brush.

U.S. Pat. No. 3,897,139 entitled: DISPOSABLE TOOTHBRUSH ASSEMBLY teaches a disposable toothbrush having a head which attaches to a handle. The toothpaste is stored in the toothbrush head. The handle inserts into the head and serves as a plunger to extrude the toothpaste into a central channel located in the center of the brush. While the '139 patent rids the traveler of the toothpaste tube the traveler is still left with a two component system; brush and handle.

Since a number of people eat away from home and there is increased concern for dental hygiene there is a need for a "traveling toothbrush" which is a sealed self-contained compact toothbrush toothpaste system suitable for carrying in one's pocket or purse without worry of discharge.

SUMMARY OF THE INVENTION

It is an object of the present invention to provide a toothbrush that can be easily collapsed.

It is an object of the present invention to provide a toothbrush which is of compact size and thus can be readily and conveniently carried.

It is an object of the present invention to provide a toothbrush-toothpaste system that will readily fit in a pocket or purse.

It is another object of the present invention to provide a toothbrush which can be readily customized so as to be used as a promotional item.

It is an object of the present invention to provide a toothbrush that can be resealed after use and thereby avoid exposing individuals and objects to the saliva which may remain on the bristles of the brush.

It is another object of the present invention to provide a tamper resistant toothbrush-toothpaste system.

It is an object of the present invention to provide a toothbrush which can be used and immediately thereafter resealed and stored without having the moisture from the bristle dampen surrounding objects.

The toothbrush of the present invention in its simplest form has a two section handle. A first handle section having a brush end with bristles and a second handle section having a terminal end with a protrusion containing a reservoir. The reservoir is contoured to conform to the profile of the brush.

Means for connecting and pivotally rotating the first handle section with respect to the second handle section are provided. It is preferred that the pivotable motion be limited between the first handle section and the second handle section such, that when the toothbrush is in an open position the protrusion and the bristles of the brush are diametrically opposed. When the toothbrush is in a closed position the reservoir encompasses the bristles.

It is preferred that the second section have a channel contoured to accept the first handle section when bristles are encompassed by the reservoir. The preferred cross section for the channel is rectangular, and the first handle section having the same cross section as the channel. Having a rectangular cross section will provide sidewalls of the channel which slideably engage the sides of the first handle section which are parallel to the sidewalls of the channel. This fit will limit air flow into and out of the reservoir.

When toothpaste is in the reservoir, loss of moisture and flavor can be reduced by providing a ridge on the surface of the first handle section which contacts the bottom of the channel and a corresponding groove in the channel and by employing a foil covering the channel.

It is further preferred that the overall length of the toothbrush in the opened position be about three inches, with the pivot point being centered and the distance between the protrusion and the bristles being about two inches.

BRIEF DESCRIPTION OF THE DRAWINGS

FIG. 1 is a schematic representation of one embodiment of the present invention illustrating a handle which is hinged such that when the handle is folded the bristles of the brush are enclosed in a reservoir.

FIG. 2 is a schematic representation of an alternate hinge configuration for the embodiment of FIG. 1.

FIG. 3 is a schematic representation of another embodiment wherein the toothbrush, when folded, forms a plane surface which can be sealed by means of a sealing element.

BEST MODE FOR CARRYING THE INVENTION INTO PRACTICE

Figure 4:
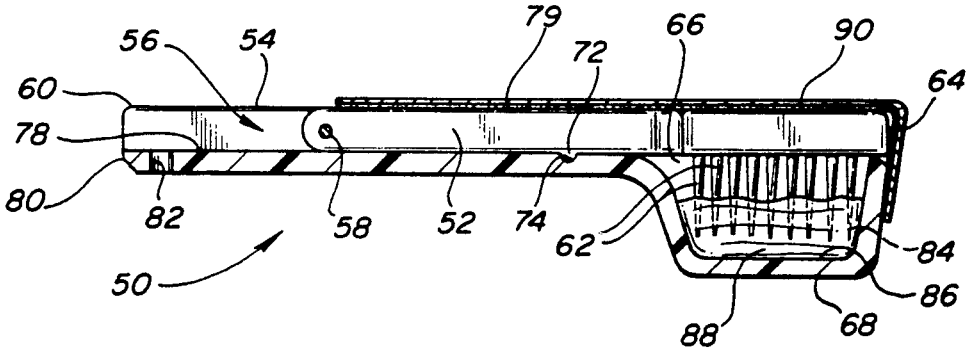
FIG. 4 is a side sectional view of the toothbrush of FIG. 3 in the closed position with toothpaste in the reservoir and a seal applied to the channel.

FIG. 1 is a perspective view of one embodiment of the folding toothbrush of the present invention. The folding toothbrush 10 has a handle 12. The handle 12 has a first handle section 14 which has a brush end 16. The brush end 16 has bristles 18. The bristles 18 can be injection molded with the first handle section 14 to form a single unit. A variety of polymers are suitable for injection molding the bristles 18 and the first section 14 as a unit. These polymers include polyethylene and polypropylene. One preferred polymer is polypropylene since this polymer does not support the growth of bacteria or mold.

A second handle section 20 has a terminal end 22 having a protrusion 24. The protrusion 24 has a reservoir 26. The reservoir 26 is contoured to the profile of the bristles 18.

Means are provided for connecting and pivotally rotating the first handle section 14 and the second handle section 20 with respect to each other. The means for connecting and rotating is a pin hinge 30. The pin hinge 30 is positioned between the brush end 16 and the terminal end 22 and is positioned such, that the reservoir 26 encompasses the bristles when the toothbrush is in the closed position. When the toothbrush is in the open position the first handle section 14 is substantially parallel to the second handle section 20.

A stop 32 is provided to limit the rotation about the pin hinge 30. The stop 32 is an extension of the second handle section 20 and has a length l which is about ⅜ in. long. A hole (not shown) is placed in the stop 32 for hanging the toothbrush when it is in the closed position.

FIG. 2 illustrates an alternative hinge and stop combination for the embodiment shown in FIG. 1. The first handle segment 42 is connected to the second handle segment 44 by a flexible element 46. The first handle segment 42 has a locking means 48 which engages the second handle segment 44 when the first handle segment 42 is parallel to the second handle segment 44.

FIG. 3 illustrates another embodiment of the present invention. A toothbrush 50 has a first handle section 52 and second handle section 54 which is illustrated at a position intermediate between the open in use position and the closed storage position. The second handle section 54 has a channel 56. The means for connecting and pivotally rotating the first handle section 52 with respect to the second handle section 54 is a pin 58 which passes through the side walls 60 of the channel 56 and the first handle section 52. The pin 58 is positioned such, that the reservoir 66 of the protrusion 68 pivotally encompasses the bristles 62 of the brush end 64.

Preferably the channel 56 is a rectangular in cross section with the first handle section 52 having the same cross section as the channel 56. With such a cross section the first handle section 52 fills the channel 56 when the toothbrush 50 is closed. The side walls 60 of the channel 56 will slideably engage the side walls 70 of the first handle segment 52. When engaged they will seal the sides of the channel 56.

A seal between the hinge and the reservoir 66 can be provided by placing a ridge 72 on the lower side groove 74 of the first handle segment 52. The ridge 72 is transverse to the channel sides 60 and engages a groove 74 in the bottom surface 78 of the channel 56.

FIG. 4 is a side sectional view of the toothbrush 50 of FIG. 3 in the closed position. The first handle segment 52 is folded into the second handle segment 54 forming a plane surface 79. The channel 56 of the second handle segment 54 extends beyond the first handle segment 52. The bottom surface 78 of the channel 56 serves as the contact surface for a stop 80. The stop 80 has a hole 82 which passes through the stop 80 and allows the toothbrush 50 to be hung when it is in the closed or folded position.

The bristles 62 of the toothbrush 50 form a profile 84 shown by the dashed line. The profile 84 is in close proximity to the reservoir surface 86.

When toothpaste is placed in the reservoir 66 and the toothbrush 50 is closed toothpaste 88 will uniformly distribute over and through the bristles 62 thus assuring the toothpaste will be distributed on the bristles.

A seal 90 can be applied to the planar surface 79 and extended to attach to the protrusion 68 to serve either of two purposes. If the seal is thermally applied then tampering with the seal will destroy the seal and provide notice that the toothbrush-toothpaste system has been violated. If the seal is attached with a non-hardening contact adhesive then the seal can be resealed after each use to limit exposure to infectious diseases which could be carried by prolonged exposure of retained saliva on the bristles of the brush. The seal also provides a place of prominence where message or promotional material can be printed. Since the seal is made and applied in separate steps small lots of toothbrushes have seals of different imprints can be supplied in a cost effective manner.

Figure 5:
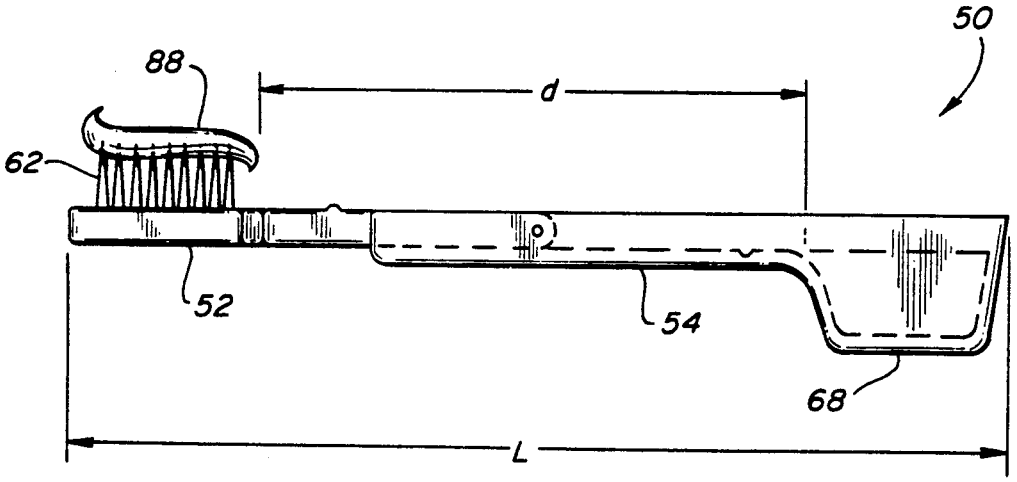
FIG. 5 is a side view of the toothbrush in the open position of FIG. 4 illustrating the bristles of the toothbrush withdrawn from the reservoir.

FIG. 5 shows the toothbrush of FIG. 4 in the open position. The toothpaste 88 remains principally on the brush since the area of the bristles 62 is substantially greater than reservoir surface 86. A release agent can be applied to the reservoir surface 86 if the surface tension between the toothpaste and the reservoir surface 86 is too great for a clean release.

In the open position the overall length L need only be about 3.5 to 4 inches long. This length will accommodate a bristle to protrusion distance d of about 1.75 inches. Having a protrusion diametrically opposed to the brush aids the user in maintaining a firm comfortable grip on the handle and thus allows its length to be reduced.

The present invention has been described in terms of preferred embodiments and particular applications. The substitution of material and/or design can be made by one skilled in the art without departing from the spirit of the invention.

What I claim is:

1. A compact toothbrush comprising:

a handle having a first handle section and a second handle section;

a brush end with bristles attached to said first handle section;

a protrusion with a reservoir forming a terminal end of said second handle section, said reservoir contoured to conform to said brush;

means for connecting and pivotally rotating said first handle section and said second handle section, said means positioned between said brush end and said terminal end and being so positioned that said reservoir will rotate to encompass said bristles;

a stop to limit said rotation such that said protrusion and said bristles are diametrically opposed in an open position, and said reservoir engages said bristles in a closed position;

a channel in said second handle section contoured to accept said first handle section and forming a planar surface when the toothbrush is in said closed position, said channel being rectangular in cross section and said first handle section having the same cross section as said cross section of said channel; and a seal for attaching to and covering said channel when said toothbrush is in the closed position.

2. The compact toothbrush of claim 1 wherein said seal is tamperproof.

3. The compact toothbrush of claim 2 wherein said pivotal point is positioned about 1.5 inches from said brush end and said protrusion with said channel being about 1.75 inches whereby said additional length serves as said stop.

4. A compact toothbrush comprising:

a handle having a first handle section and a second handle section;

a brush end with bristles attached to said first handle section;

a protrusion with a reservoir forming a terminal end of said second handle section, said reservoir contoured to conform to said brush;

means for connecting and pivotally rotating said first handle section and said second handle section, said means positioned between said brush end and said terminal end and being so positioned that said reservoir will rotate to encompass said bristles;

a stop to limit said rotation such that said protrusion and said bristles are diametrically opposed in an open position, and said reservoir engages said bristles in a closed position;

a channel in said second handle section contoured to accept said first handle section and forming a planar surface when the toothbrush is in said closed position;

toothpaste in said reservoir and wherein said toothbrush is in said closed position; and a seal attaching to and covering said channel.

5. A compact toothbrush comprising:

a handle having a first handle section and a second handle section;

a brush end with bristles attached to said first handle section;

a protrusion with a reservoir forming a terminal end of said second handle section, said reservoir contoured to conform to said brush;

means for connecting and pivotally rotating said first handle section and said second handle section, said means positioned between said brush end and said terminal end and being so positioned that said reservoir will rotate to encompass said bristles;

a stop to limit said rotation such that said protrusion and said bristles are diametrically opposed in an open position, and said reservoir engages said bristles in a closed position;

a channel in said second handle section contoured to accept said first handle section and forming a planar surface when the toothbrush is in said closed position, said channel being rectangular in cross section and said first handle section having the same cross section as said cross section of said channel;

toothpaste in said reservoir and wherein said toothbrush is in said closed position; and a seal attaching to and covering said channel.

* * * * *